United States Patent [19]

Foster et al.

[11] Patent Number: 4,476,801

[45] Date of Patent: Oct. 16, 1984

[54] MOORING DEVICE

[75] Inventors: Derek Foster; Colin Rich, both of Brampton, Canada

[73] Assignee: John T. Hepburn Limited, Mississauga, Canada

[21] Appl. No.: 417,264

[22] Filed: Sep. 13, 1982

[51] Int. Cl.[3] ..... B63B 21/50

[52] U.S. Cl. ..... 114/230; 114/293; 254/372; 254/285

[58] Field of Search ..... 114/144 B, 179, 180, 114/181, 199, 200, 210, 230, 264, 293; 242/55 BW; 254/288, 372, 284, 285, 286, 290, 291, 292, 293

[56] References Cited

U.S. PATENT DOCUMENTS

| | | | |
|---|---|---|---|
| 3,967,572 | 7/1976 | Lea | 114/293 |
| 3,985,093 | 10/1976 | Eidem | 114/230 |
| 4,020,779 | 5/1977 | Kilt | 114/230 |
| 4,078,768 | 3/1978 | Krogstad et al. | 254/285 |

FOREIGN PATENT DOCUMENTS

| | | | |
|---|---|---|---|
| 197711 | 11/1977 | U.S.S.R. | 114/293 |

*Primary Examiner*—Trygve M. Blix
*Assistant Examiner*—Thomas J. Brahan
*Attorney, Agent, or Firm*—Rogers, Bereskin & Parr

[57] ABSTRACT

A mooring device is secured to a sea-going vessel to handle anchor line of the type having an upper length of wire rope in series with a lower length of chain cable. The mooring device comprises a traction winch for handling the wire rope and a windlass for handling the chain cable. The windlass includes a chain wheel so positioned beneath the winch when the mooring device is located in its operative position that the anchor line can be hauled by the winch substantially vertically between flanges of the chain wheel. In operation the wire rope can be hauled up or paid out without actively engaging the chain wheel, the flanges merely serving as a guide to ensure that the anchor line is properly located for chain handling functions. When a portion of anchor line at the junction between the wire rope and chain cable is drawn above the chain wheel, a chain holder can be engaged to take up the tension in the chain cable, and a hydraulic anchor line retractor is then activated to draw the anchor line portion generally horizontally from its vertical position to a retracted position in which links of chain are draped over link-gripping whelps of the chain wheel. The chain hanger can then withdraw, after the windlass is activated to haul the chain cable upwardly. A conventional static and dynamic brake system is provided to regulate the paying out of anchor line during a substantially reverse process.

8 Claims, 4 Drawing Figures

MOORING DEVICE

FIELD OF THE INVENTION

The invention relates generally to mooring devices for handling anchor lines, and in particular to mooring devices for use in anchoring off-shore drilling platforms in deep water.

DESCRIPTION OF PRIOR ART

An off-shore drilling platform is commonly located over a drill hole by a plurality of anchor lines secured to the sea floor. The anchor lines must be constructed to provide good mooring characteristics, that is, limited excursion of the drill platform from its location over the drill hole and a tendency for the platform to return quickly to its required location when disturbed, and also to ensure solid anchoring at the sea floor. Of the two types of anchoring line commonly used, wire rope and chain cable, wire rope tends to display better mooring characteristics in deep water applications. In shallow water, chain cable is preferable, providing a deeper catenary because of its greater weight per unit length. The greater line sag ensures that the chain anchor line is substantially horizontally directed near the sea floor, thereby ensuring that any pull on the anchor line tends to embed the anchor more securely in the sea floor.

In deep water applications a compromise is usually made, and a composite anchoring line constructed with an upper length of wire rope and a lower length of chain cable. With such anchor lines satisfactory mooring and good anchor holding characteristics are simultaneously obtained. However, the anchored vessel must now be equipped to handle two different types of anchor line, or be dependent on attendant service vessels to handle the length of chain cable.

Several systems have been developed to handle such composite anchoring lines. These systems generally comprise winch and windlass combinations. The term "winch" as used in the specification should be understood as a device adapted to haul and pay out wire rope, and the term "windlass" should be understood as a device for hauling and paying out chain cable. The windlass generally comprises a chain wheel commonly referred to in North America as a "wildcat" (and in Europe as a "gypsy"). The wildcat typically comprises a hub, paired flanges secured to the hub, and a number of whelps (typically five to seven pairs in drill platform mooring applications) which extend inwardly from the flanges to grasp chain links.

In one prior art system the wire rope and chain cable of a composite anchor line are detachably connected with a special joiner link. During collection of the anchor line, the wire rope is hauled in with a winch, the chain cable secured to the deck of a vessel with a chain stopper, and the joiner link disassembled. A chain pendant extending from the windlass is then secured to the chain cable, and the windlass activated to collect the remaining anchor line. The process is reversed to pay out anchor line. A problem associated with such a system is that manipulation of the joiner link and chain pendant can be hazardous in rough weather, and tends to be time consuming. Additionally, a large portion of deck area is required for the various system components.

Another prior art system seeks to avoid disconnection of the wire rope and chain cable by incorporating an over-sized chain wheel. The chain wheel functions as a conventional sheave during collection of the wire rope, the wire rope being run over the hub of the chain wheel until the chain cable is raised. The chain wheel is then operated as a wildcat to gather the remaining anchor line. The system is very space consuming and the chain wheel tends to be very large and heavy, resulting in an over-sized windlass.

Another system seeks to avoid use of a windlass entirely. In the system the anchoring line is hauled by winch through a tortuous path in the interior of a vessel. The path is sufficiently long to store a limited length of extra heavy chain cable. Although the system is relatively simple, very poor use is made of vessel space, and highly tensioned lines must be taken through the vessel interior, with consequent increased damage hazard.

In another system, a traction winch (associated with a drum-type storage winch), a windlass and a sheave constructed to pass both wire rope and chain cable are mounted on a horizontal deck portion of a vessel. The windlass is positioned between the traction winch and sheave, and so oriented that wire rope, which travels generally horizontally between the traction winch and sheave, is guided between the flanges of the wildcat. The sheave is dimensioned sufficiently large and so placed that the wire rope is vertically spaced from the hub and whelps of the wildcat. When all wire rope has been collected and a portion of chain cable is located over the wildcat, the chain cable is temporarily secured at the sheave (which is equipped with a chain stopper) of the vessel, and wire rope paid out to allow the portion of chain cable to settle under gravity onto the whelps of the wildcat. The wild cat is then activated to collect the chain cable which is deposited into a chain locker beneath the deck.

BRIEF SUMMARY OF THE INVENTION

The invention provides a mooring device for handling composite anchor line comprising an upper length of wire rope in a series with a lower length of chain cable. The device comprises winch means for handling the wire rope, and windlass means for handling the chain cable. The windlass means include a chain wheel so positioned beneath the winch means when the mooring device is located in its operative position that the anchor line can be hauled substantially vertically between the flanges of the chain wheel by the winch means. In operation the wire rope can be hauled up and paid out without actively engaging the chain wheel, the flanges of the chain wheel merely serving as a guide to ensure that the anchor line is properly located for chain handling functions.

The mooring device also includes anchor line retraction means (such as a hydraulically activated cylinder assembly with a releasable fastener) for releasably drawing a portion of the anchor line having a lower portion composed of links of the chain cable from a substantially vertical position in which the anchor line portion extends from the winch means downwardly between the flanges of the chain wheel to a retracted position. In the retracted position the links of the lower portion are draped over the whelps of the chain wheel, and the windlass means can then be activated to rotate the chain wheel to haul the chain cable upwardly.

DESCRIPTION OF A PREFERRED EMBODIMENT

Figure 1:
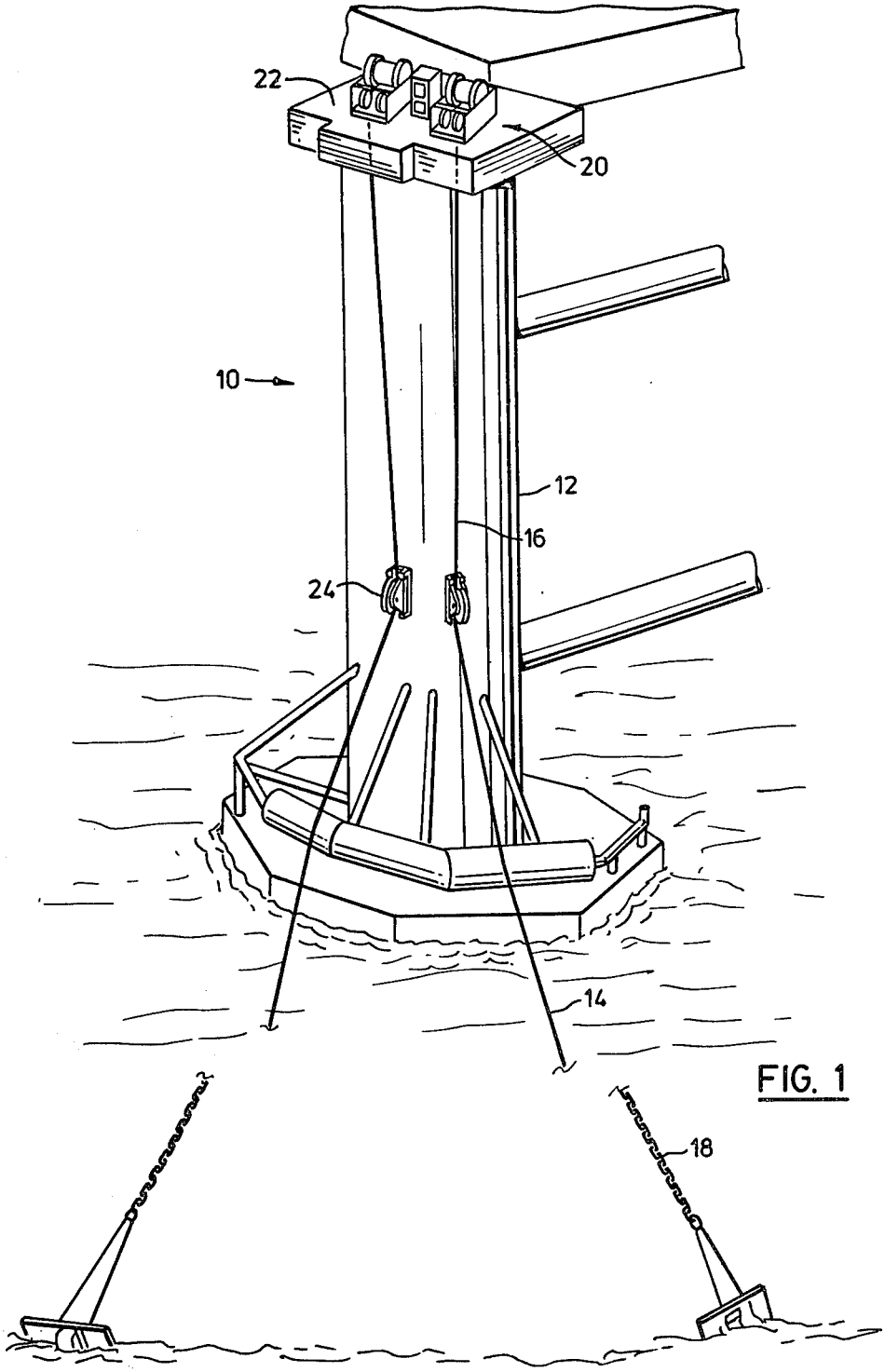
FIG. 1 is a perspective view illustrating a portion of a drilling platform with a mooring system incorporating a preferred embodiment of a mooring device constructed according to the invention.

Reference is made to FIG. 1 which illustrates a drill platform 10 floated by a plurality of buoyant legs 12. The platform 10 is secured to the sea floor in part by an anchor line 14 comprising an upper length of wire rope 16 constructed of galvanized steel and a lower length of stud link chain cable 18. The lower end of the wire rope 16 is fitted to a socket and connected by means of special joiner link to the upper end of the chain cable 18. The jointure is such that the anchor line 14 can pass over a conventional fairlead sheave without significant bending at the socket/wire rope interface.

Figure 2:
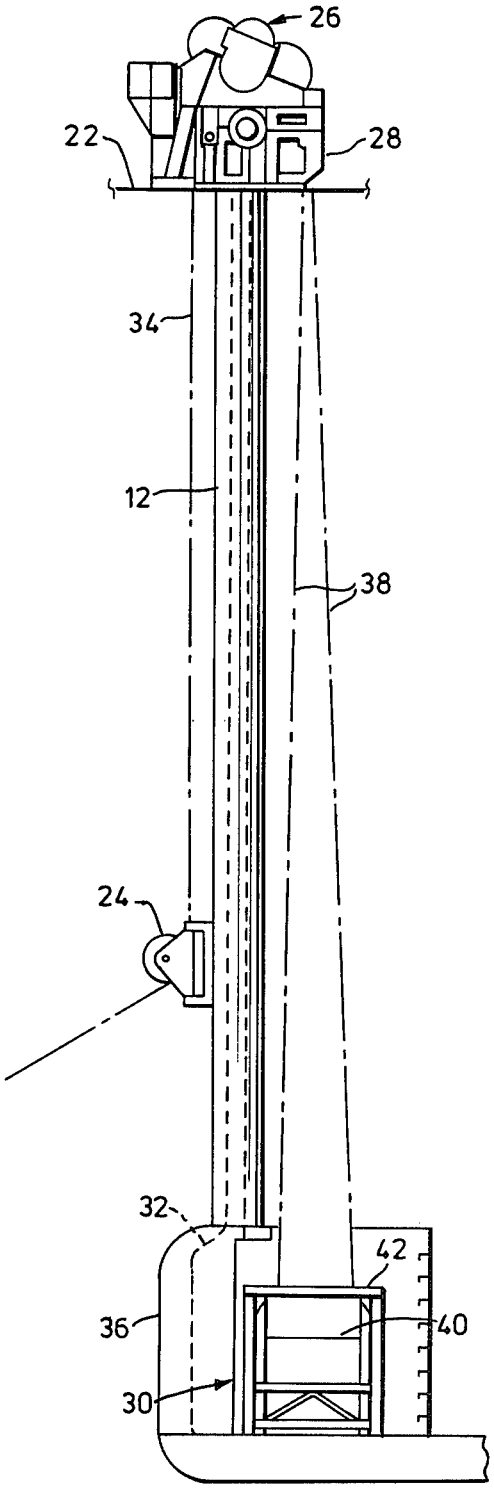
FIG. 2 diagrammatically illustrates various elements of the mooring system and the paths followed by a composite anchor line; and, FIGS. 3-4 are side and end views of the mooring device.

The anchor line 14 is handled by a mooring system diagrammatically illustrated in FIG. 2. The mooring system includes a mooring device 20 (constructed according to the invention) located on the horizontal deck portion 22 over-hanging the leg 12. The mooring system consists basically of a fairlead sheave 24, a traction winch 26 and a windlass 28 (both comprised by the device 10), a storage winch 30, and a chain locker 32 defined in the leg 12 below the device 10.

The path of the wire rope 16 in the mooring system is illustrated in dashed lines in the view of FIG. 2. The wire rope 16 is guided by the fairlead sheave 24 and traction winch 26 along the vertical path 34. The fairlead sheave 24 is of the type adapted for submerged service, and has a shallow groove surrounding a relatively central deeper groove, which grooves co-operate to permit passage of rope or chain links (every second link of the chain cable extending into the central groove).

Wire rope gathered by the traction winch 26 is collected by the storage winch 30 which is located in the drill platform pontoon 36 below the leg 12. The downward path of the wire rope 16 is bounded by two paths 38, which represent extreme positions of the wire rope 18 as it is payed back and forth across a spool 40 of the storage winch 30 by the level wind (spool guide) 42. The storage winch 30 is located in the foot 36 of the leg 12 in order to preserve deck space and also to lower the centre of gravity of the drill platform 10.

The chain cable 18 moves along the same vertical path 34 as does the wire rope 16, but is dropped into a chain locker 32 by the mooring device 20 (or raised from the chain locker 32 when the anchor line 14 is paid out).

Figure 3:
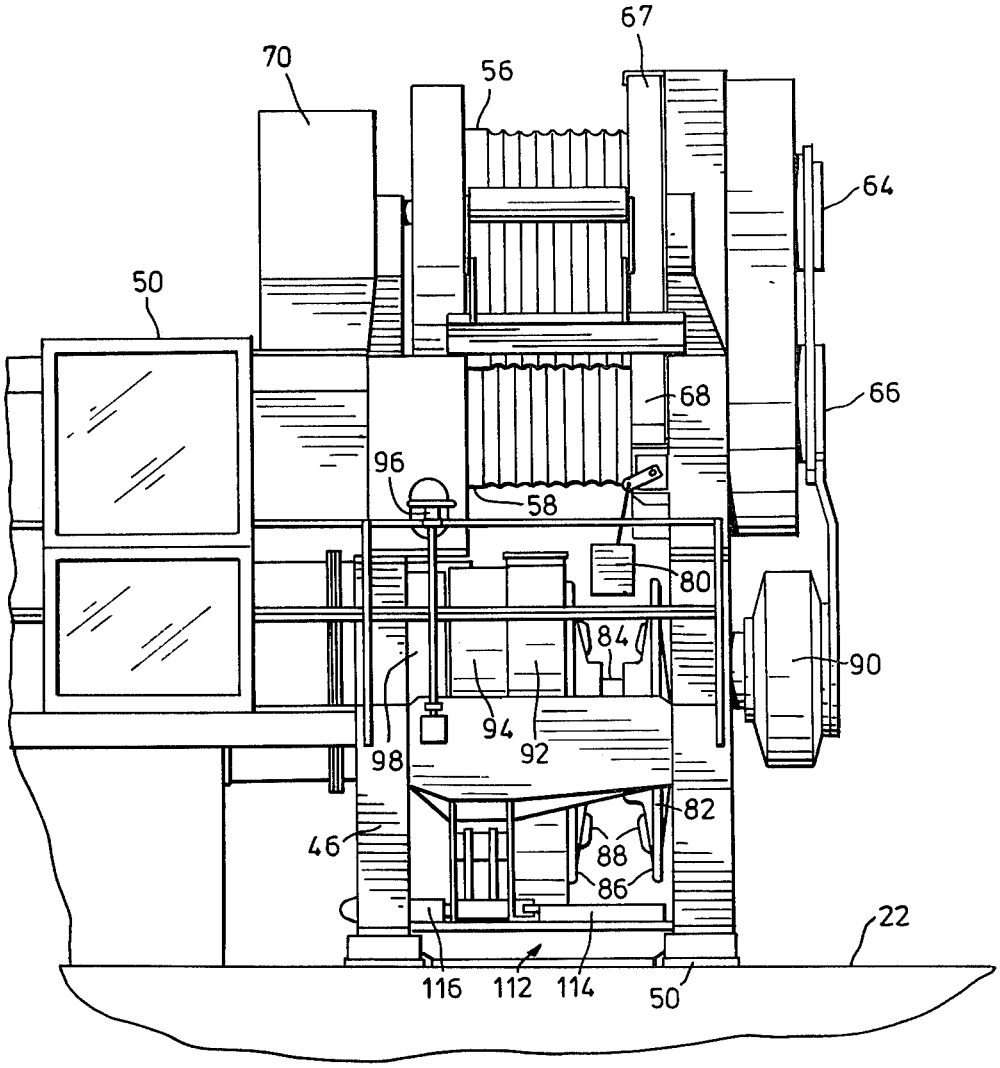
Figure 4:
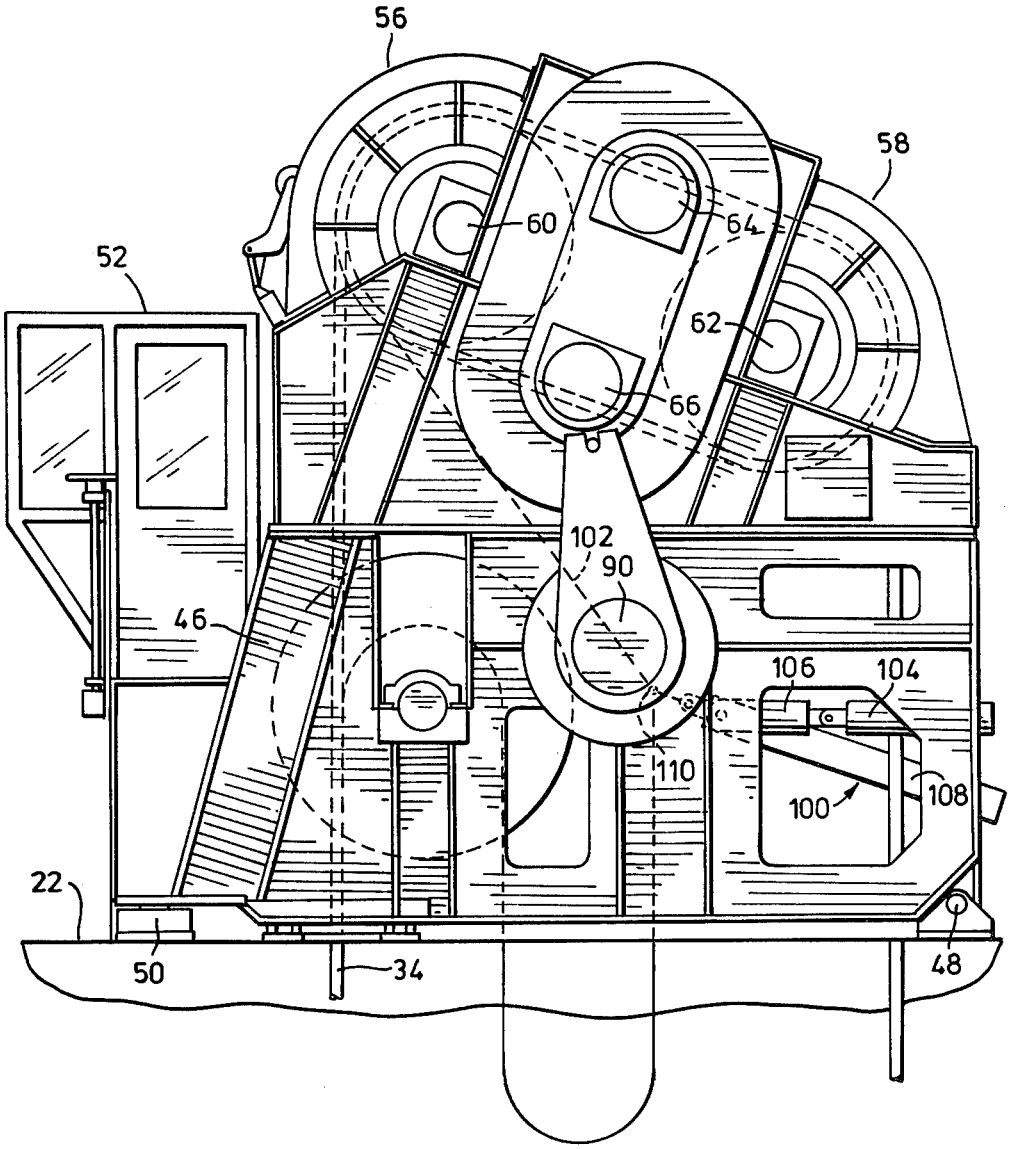

The mooring device 20 is illustrated in greater detail in the views of FIGS. 3-4. The mooring device 10 will often be constructed in symmetric halves to permit handling of two anchor lines. Only the apparatus necessary for handling the anchor line 14 is specifically illustrated. The mooring device 10 may often be located in groups of two or three depending on the hull platform mooring arrangement. The devices so grouped may be independent, or use a common power source, or be coupled together to be driven by a common prime mover through an arrangement of cross-shafts and clutches.

The mooring device 20 includes a support frame 46 (generally of ribbed and flanged steel plate construction) on which are mounted the traction winch 26 and windlass 28. The support frame 46 is pivotally connected at 48 to the deck portion 22, and at an opposite end the support frame 46 bears down on a load cell 50 which indicates on a control panel in a control cab 52 the tension in the anchor line 14.

The traction winch 26 comprises conventional grooved drums 56, 58 rotatably mounted in a support frame 46 on shafts 60, 62. The drums 56, 58 have a number of grooves on which the wire rope 16 is wound and frictionally held. The drums 56, 58 are rotated to collect or pay out the wire rope 16 by means of hydraulic motors 64, 66. Each motor 64, 66 is coupled to bull (annular) gears 67, 68 secured respectively to the flanges of the drums 56, 58. To this end pinion gears (not illustrated) driven by the motors 64, 66 mesh with the external teeth of both bull gears 67, 68. An alternative drive can employ electrical motors and reduction gear box to drive one or more pinions meshing with the bull gears 67,68.

The traction winch 26 has main and auxiliary brakes for regulating the paying out of the anchor line 14. The main brakes are of the band brake type, spring applied and hydraulically released, and may be sized to hold the anchor line 14 at predetermined tensions up to that sufficient to break the wire rope 16. The auxiliary brakes 70 are fitted to a shaft (not illustrated) extending from the pinion gear of the upper drive motor 64. The auxilliary brakes 70 are of the multiple disk water cooled type. These are intended to supplement the braking capacity of the storage winch 30 during deep water anchor handling. It will be appreciated that the motors 64, 66 can be set into a free-wheeling mode during the paying out of the anchor line 14 with the main and auxiliary brakes controlling in part the paying out of the anchor line 14.

A limit switch 80 is provided to detect when the joiner link of the wire rope 16 and chain cable 18 has risen above the windlass 28. The limit switch 80 is of common construction, involving a lever arm positioned to be tripped by the joiner link, and is electrically coupled to controls regulating the operation of the winch drive to discontinue collection of the wire rope 16 when the chain links are detected.

The windlass 28 comprises a conventional wildcat 82 having a hub 84, paired flanges 86 and five pairs of whelps 88 (only one pair being specifically indicated) for gripping the chain links of the chain cable 18. The wildcat is driven by a pair of hydraulic motors 90 (only one specifically illustrated) which engage a bull (annular) gear 92 secured to the periphery of one of the flanges 86. The motors 90 are mounted at opposite ends of a drive shaft (not specifically illustrated) to which is also secured a pinion gear (not illustrated) which meshes with the bull gear 92. Alternatively an electric motor and gearbox (which can be a drive unit common to both the traction winch 26 and windlass 28 can be used to drive the windlass 28.

Operation of the windlass 28 during the paying out of anchor line 14 is regulated by a main brake 94 consisting of spring applied, hydraulically released band brakes whose brake path is a flange extension to which the bull gear 92 is secured. These brakes are sized to hold the anchor line 14 against predetermined tensions up to that sufficient to break the chain cables 18. A manual override 96 for these brakes is provided. Additionally, a dynamic brake 98 is mounted on the same shaft inboard of one of the motors 90. The dynamic brake is of the multi-disk water cooled type.

The storage winch 30 is driven by a hydraulic motor, (or alternatively an electric motor) and provides the back tension necessary for the operation of the traction winch 26. The storage winch 30 is provided with disk brakes having two types of calipers. One type of caliper brake (spring applied, pressure released) serves as a parking brake to automatically engage when the storage winch 30 is stopped. The two remaining sets of caliper brakes are intended for dynamic operation and apply varying pressure to the brake disk to provide suitable back tensioning or retardation during anchor handling operations. The dynamic brakes 98 are controlled from the control cab 52 (or a remote console if a control cab is not provided) and may be adjusted to varying braking as wire rope is payed out from outer to inner layers on the drum of the storage winch 30. Any supplementary braking power required is provided by the dynamic brakes of the traction winch 26. It will be appreciated that the motor operating the storage winch 30 can be placed in a free-wheeling mode or declutched mode to permit the storage winch drum to pay out wire rope freely under the pull of an anchor handling vessel.

The relative position of the grooved drum 56 of the traction winch 28 and of the wildcat 82 should be noted. The relative orientation is such that during upward hauling of the anchor line 14 the wire rope 16 is guided between the flanges 82 of the wildcat 82, substantially at what will be the pitch circle diameter of the chain cable 18 when engaged by the wildcat 82 for hauling. Thus the wire rope 16 does not actively engage the wildcat 82, and a retraction mechanism 100 must be provided to draw a portion of the anchor line 14 generally horizontally from a vertical path 34 to a retracted position when it is necessary to engage the links of the chain cable 18 with the whelps 88 of the wildcat 82.

The retraction mechanism 100 comprises a pair of hydraulic cylinders 104, 106 which act in part along a track 108. The cylinder 104 advances and withdraws the cylinder 106 along the track 108. The track 108 in turn directs the cylinder 106 when expanding towards the joiner link (symbolically illustrated in a retracted position as 110) at its location on the vertical path 34 when the limit switch 80 discontinues upward hauling by the traction winch 26. A flexible fibre rope can be used to secure the joiner link 110 to the cylinder 106 (or alternatively a variety of fasteners can be used). The cylinder 104 is contracted, followed by the cylinder 106, to draw the anchor line portion to the retracted position illustrated. In contemplated use aboard offshore drilling platforms the retraction mechanism 100 will typically be constructed to withstand a pulling force of 45 tons, but will be varied according to the requirements of particular applicants. An upper portion of the retracted anchor line portion consists of wire rope and is kept clear of the wildcat 82 when retained in the retracted position. A lower portion consisting of chain links is simultaneously draped over the whelps 88 of the wildcat 82, to permit collection of the chain cable.

To permit retraction of the anchor line portion, a hydraulically activated chain holder 112 is provided. The chain holder 112 is a relatively simple mechanism comprising a two-pronged steel fork 114 which can be extended about or retracted from about a link of the chain cable 18 by means of a hydraulically activated cylinder 116. This eliminates the necessity of having an operator manually secure the chain cable 18 to the deck portion 22, the chain 18 being hydraulically securable instead to the support frame 46. When the chain is secured to the support frame 46, the traction winch 26 can be placed in a free-wheeling mode, so that the retraction of the anchor line portion is substantially unresisted. A reverse process would of course be followed in paying out the anchor line 14, when it is necessary for the traction winch 28 to take up the tension on the line 14.

Recovery of the anchor line 14 proceeds essentially as follows. The wire rope 16 is hauled upwardly by the traction winch 28, and collected below deck by the storage winch 30. The anchor line 14 rises until the limit switch 80 is engaged by the joiner link 18. (Alternatively the operator can visually determine when the chain cable 18 has risen sufficiently). The chain holder 112 is then inserted about the links of the chain cable 18 to take up the tension in the anchor line 14, the drive of the traction winch 26 being put in the free-wheeling mode to permit this. The retraction mechanism 110 is then advanced to meet the joiner link 100 (or alternatively an upper link of the chain cable 18), and secured to the joiner link 110. The retraction mechanism 100 is then activated to draw the anchor line portion containing the joiner link 110 into the retracted position 102, with links of the chain cable 18 engaging the whelps 88 of the wildcat 82. The chain holder 112 is then retracted to permit the windlass 28 to collect the chain cable, and deposit the chain cable in the chain locker 32.

Paying out the anchor line is essentially a reverse process. The drive of the traction winch 26 is placed in a free-wheeling mode, and the various brakes described above are used to deploy the chain cable 18. Once most of the chain cable 18 has been deployed, the chain holder 112 is activated to take up the tension in the chain cable 18. The joiner link 110 is then disengaged from the retraction mechanism 100, and the traction winch 26 then activated to take up the slack in the anchor line 14, whereafter the chain holder 112 is retracted. Motors of the traction winch 26 are placed in a free-wheeling mode, and the braking mechanisms of the storage winch 30 and traction winch 26 are used to control the paying out of the remainder anchor line 14.

As mentioned in the discussion of the prior art above, traction winch and windlass combinations for the handling of composite anchor lines are well known. Consequently details respecting the construction and operation of various components of the mooring system and mooring device 10 which have not been set out will be readily apparent to one skilled in the art of mooring drill platforms and sea-going vessels.

It will be apparent that many modifications can be made to the system and device 10 described above without departing from the scope and spirit of the invention. In particular, the traction winch could be replaced by a drum-type winch and a sheave positioned to direct wire rope downwardly between the flanges of a wildcat, although a traction winch is strongly preferred. Additionally, although the traction winch 26 and wildcat 82 have been shown disposed to one side of a hypothetical plane containing the vertical path 34, they could be located on opposite sides of such a plane, with the function of the retraction mechanism accordingly adjusted, although such a device would not be particularly compact.

We claim:

1. A mooring device for handling anchor line of the type comprising an upper length of wire rope in series with a lower length of chain cable, the mooring device comprising:

a support frame;

winch means secured to the support frame for hauling and paying out the wire rope;

windlass means secured to the support frame for hauling and paying out the chain cable including a chain wheel having a hub, a pair of flanges fixed to the hub and whelps for grasping links of the chain cable between the flanges, the chain wheel being so positioned relative to the winch means when the mooring device is located in its operative position that the anchor line can be hauled substantially vertically between the flanges of the chain wheel by the winch means; and, anchor line retraction means secured to the support frame for releasably drawing a portion of the anchor line having a lower portion composed of links of the chain cable from a substantially vertical position in which the anchor line portion extends from the winch means downwardly between the flanges of the chain wheel to a retracted position in which the lower portion engages the whelps of the chain wheel whereafter the windlass means can be activated to rotate the chain wheel thereby hauling the chain cable upwardly.

2. A mooring device as claimed in claim 1 comprising chain holding means for releasably securing the chain cable to the framework, whereby, tension can be released from the anchor line portion during drawing of the anchor line portion from the vertical to retracted position.

3. A mooring device as claimed in claim 1 in which the winch means comprise a traction winch for hauling the wire rope.

4. A mooring device as claimed in claim 1, 2 or 3 in which the winch means and chain wheel are so oriented relative to one another that when the mooring device is located in its operative position the winch means and chain are located substantially to the same side of a plane containing the vertical path along which the anchor line is hauled between the flanges of the chain wheel.

5. The combination of a sea-going vessel and a mooring device secured to the vessel to handle anchor line comprising an upper length of wire rope in series with a lower length of chain cable, in which the mooring device comprises:

winch means for drawing the wire rope upwardly along a substantially vertical path;

windlass means for collecting the chain cable, including a chain wheel having a hub, a pair of flanges secured to the hub and whelps for grasping links of the chain cable between the flanges the chain wheel being so positioned that the anchor line is drawn substantially vertically between the flanges of the chain wheel by the winch means; and, anchor line retraction means for drawing a portion of the anchor line from the vertical path to a retracted position in which an upper portion of the anchor line portion is kept clear of the chain wheel and a lower portion of the anchor line portion having chain links is draped over the whelps of the chain wheel so that the windlass can be activated to rotate the chain wheel to collect the chain cable.

6. The combination of claim 5, further comprising chain holder means for releasably securing the lower portion of the anchor line portion to the vessel.

7. The combination of claim 5, in which the winch means comprise a traction winch for drawing the wire rope upwardly and a storage winch for storing the wire rope drawn by the traction winch.

8. The combination of claim 5, 6, or 7 in which the traction winch and chain wheel are located substantially on one side of a plane containing the vertical path.

* * * * *